United States Patent [19]

Perne et al.

[11] Patent Number: 4,699,285

[45] Date of Patent: Oct. 13, 1987

[54] CLOSURE DEVICE FOR BOTTLES COMPRISING A SCREWABLE CAP

[75] Inventors: Raymond Perne, Anse; Jean Huitel, Perrignier, both of France

[73] Assignee: Astraplastique & Societe Anonyme des Eaux Minerales d'Evian, Evian, France

[21] Appl. No.: 821,461

[22] Filed: Jan. 22, 1986.

[30] Foreign Application Priority Data

Jan. 23, 1985 [FR] France ..... 85 00909

[51] Int. Cl.[4] ..... B65D 41/34

[52] U.S. Cl. ..... 215/252; 215/31; 215/329; 215/344

[58] Field of Search ..... 215/329, 344, 354, 230, 215/252

[56] References Cited

U.S. PATENT DOCUMENTS 3,370,732 2/1968 La Vange ..... 215/344

4,021,524 5/1977 Grimsley ..... 264/242

FOREIGN PATENT DOCUMENTS 119788 9/1984 European Pat. Off. ..... 215/329
2323561 11/1974 Fed. Rep. of Germany .
1553571 1/1969 France .
2045867 3/1971 France .
2172029 9/1973 France .
2320870 3/1977 France .
2477507 9/1981 France .

*Primary Examiner*—Donald F. Norton
*Attorney, Agent, or Firm*—Oblon, Fisher, Spivak, McClelland, & Maier

[57] ABSTRACT

A closure device for bottles comprising a cap with a pilfer or tamper proof strip, and with thread conical screwing means on the neck of the bottle and on the cap. The screwing means comprises insert means adapted to cooperate with a cylindrical part of the neck bottle and a lip outside the insert and designed to provide a longitudinal positioning stop.

20 Claims, 8 Drawing Figures

CLOSURE DEVICE FOR BOTTLES COMPRISING A SCREWABLE CAP

BACKGROUND OF THE INVENTION

1. Field of the Invention

The invention relates to a closure device for bottles comprising a screwable cap.

It relates more particularly to such a device comprising a plastic material cap with a pilfer or tamper proof strip integral with said cap as long as the bottle has not been opened a first time.

2. Description of the Prior Art

Numerous devices of this type are already known which find applications more particularly for closing bottles containing drinks such as aerated or mineral waters.

The simple constructions of known devices, in which a cylindrical thread of the cap cooperates with a mating thread on the neck of the bottle are not always satisfactory in so far as their sealing is concerned, whereas more complex constructions are difficult and expensive to manufacture. In known devices, the sealing depends not only on the relative hardness of the materials forming the bottle and the cap, but also on the degree of mechanical accuracy of the parts which cooperate together, as well as on the more or less good quality of screwing during the bottling operation.

Now, because of their methods of manufacture, plastic material bottles obtained by extrusion/blowing of PVC frequently have imperfections of shape as regards their neck and as regards their neck end face, which is not always rigorously flat due to the cut of the plastics tube resorted to to manufacture the bottle. Moreover, and for bottles of this type with a rectangular cross section, different elongations of the neck and of the non cylindrical part adjacent thereto sometimes give rise to deformations of the neck and to oval shaped parts therein, which result in unsatisfactory stoppering of the bottles particularly when modern bottling machines are used whose capacity is of the order of 30,000 bottles per hour. The consequences then are deterioration of the contents of the bottle or else, for bottles containing fizzy drinks, risks of seeing the cap expelled during bottling or during transport and storage at a selling point.

In order to solve this problem, attempts have been made using insert type caps with conical thread means adapted to cooperate with matching thread means of the bottle.

Such a cap is shown, for instance, in DE-A-2 323 561. In the cap there described, however, sealing is obtained through cooperation of an edge of the container with a groove of the cap. Accordingly, such a device cannot be used for bottles which might show slight differences in shape, such as PVC extrusion/blown bottles. In addition, the cap described in the prior art publication has an angle of about 30° so that the cap is thick and thus costly.

OBJECTS OF THE INVENTION

Consequently an object of the invention is to provide an improved closure device for bottles comprising a screwable cap which in all cases provides an excellent quality of sealing and thus overcomes the drawbacks mentioned above of known devices.

Another object of the invention is to provide such a device particularly well adapted to stoppering bottles made from a plastic material, more particularly from PVC, and which, having a rectangular cross section, are manufactured by extrusion/blowing, either in the usual way or by bioorientation.

A further object of the invention is to provide a device whose cost is comparable to that of known screw or snap fit devices and which is simple to use in the bottling factory, more particularly in such factories with a high hourly output rate.

Finally, an object of the invention is to provide a device of the above-mentioned type which overcomes the constraints related to the different kinds of materials forming the bottle and cap while providing in all circumstances an excellent seal.

SUMMARY OF THE INVENTION

These objects are attained by a device in accordance with the invention which comprises a cap with an insert molded as a single piece from a plastic material. The cap is adapted to be fitted to a bottle by screwing using conical thread means. The insert provides a surface sealing means by cooperation of the external face of its side wall with the internal surface of a substantially cylindrical collar at the free end of the neck of the bottle. A lip is adapted to cooperate with a substantially truncated cone shaped bearing zone formed at the free end of the collar at the end of screwing of the cap on the bottle. The bearing zone is provided adjacent the insert and outside thereof.

The taper of the thread means is between 2° and 10° and is advantageously on the order of 3°.

In one embodiment, the insert is a cylindrical skirt with an external surface of a diameter slightly greater than that of the internal surface of the collar in the unclosed position of the device. The lip, is of annular shape and of a diameter slightly greater than that of the external surface of the skirt. The lip is provided at the junction of the skirt and the bottom of the cap.

In another embodiment, the insert is a cup with truncated cone shaped side wall in the unclosed position of the device and with a bottom having a taper directed outwardly of the cap and an extra thick portion at its center. The cup is connected to an annular bottom zone of the cap by a fold having a greater resilient deformability than the rest of the cap and in the vicinity of which the lip is formed.

According to another feature, the abutment lip is formed by the end of a short cylindrical sleeve adjacent the fold with greater resilient deformability and connecting the latter to the annular bottom zone of the cap.

The device of the invention comprises a pilfer or tamper proof strip which has catches spaced evenly apart over the internal periphery of the strip. The catches are adapted to cooperate with antireturn notches of conjugate shape formed at regular intervals over the periphery of the external face of the neck of the bottle when the cap is completely screwed thereon.

The invention also contemplates providing a bottle adapted to be part of a stoppering device such as above defined. The bottle is obtained by forming a plastic material and has a conical thread in its neck part. The forming is an operation of extrusion/blowing of PVC during which the bottle is formed in the vicinity of its free end with a collar having a substantially cylindrical internal surface. The collar is continued in the direction of the free end by a substantially truncated cone shaped part.

To match the bottle, the invention provides a cap comprising a conical thread on the internal face of its side wall and an insert adapted to penetrate into the neck of the bottle which the cap is intended to equip. The cap is molded from a high density polyethylene. The insert is a skirt or a cup connected to a bottom. A circular abutment lip is formed on the external face of the side wall of the insert in the vicinity of the junction between the insert and the bottom.

The conical thread of the cap is an artillery type thread with a taper angle of about 2° to 10°, advantageously on the order of 3°.

In one embodiment, the insert is shaped as a cup having a concave bottom with a slight extra thickness at its center and a side wall connected to an annular bottom zone. A zone or fold of greater resilient deformability than the rest of the cap connects the cup to a cylindrical part connecting to the bottom annular zone, the circular abutment lip forming the end of the cylindrical part.

The cap comprises a pilfer or tamper proof strip and is advantageously provided with a metal sealing foil thermowelded or thermobonded to the zone and adjacent thereto.

DESCRIPTION OF THE PREFERRED EMBODIMENTS

Figure 3A:
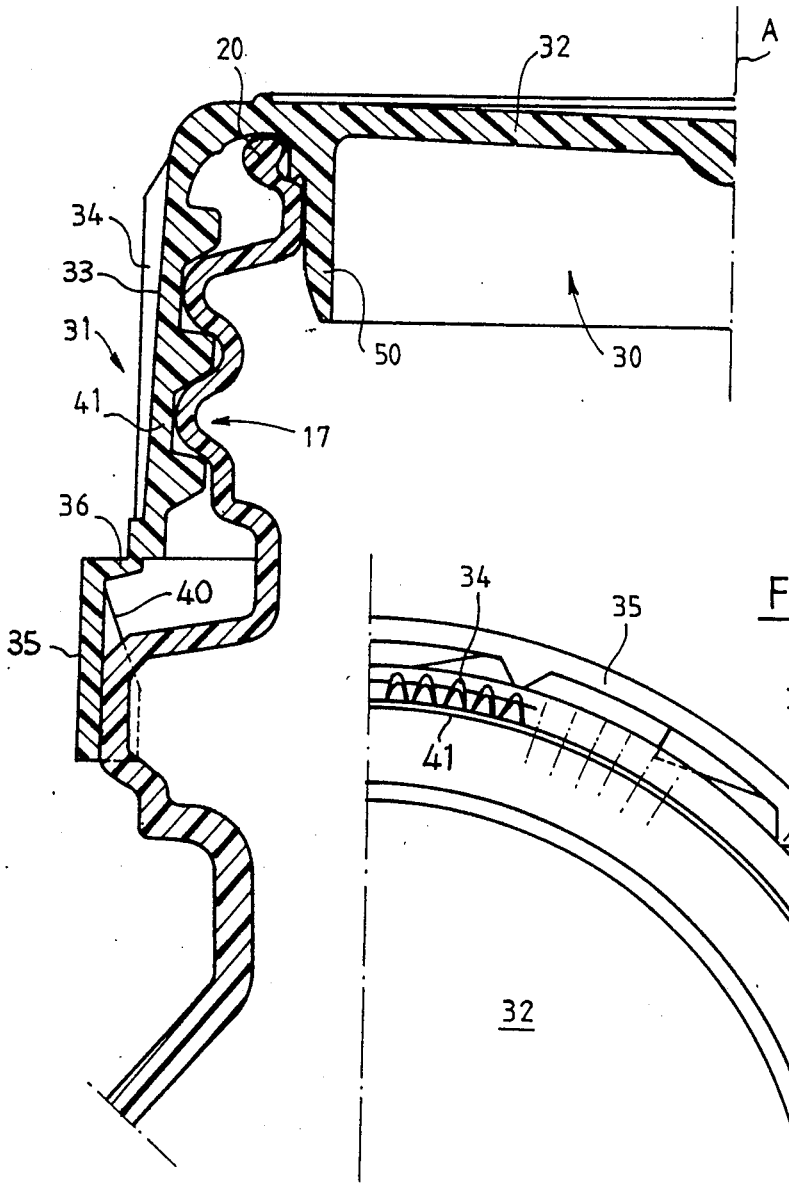
FIG. 3*a* is a partial view in longitudinal section of a bottle comprising a device in accordance with the invention with a cap of the type shown in FIGS. 1 and 2.

References will first be made to FIGS. 1 to 3*a*. In the embodiment illustrated in these Figures, the device of the invention is provided for use with a bottle made from a plastic material, for example from PVC. The bottle advantageously is obtained by extrusion/blowing and has a circular cross section. Bottle B is shaped, in its part opposite the bottom C, along a collar 10 which allows—by an annular zone 11 substantially perpendicular to the axis A of the bottle and a substantially cylindrical zone 12. The holding and centering of the bottle by means of a star, not shown, during the bottling operation.

The substantially cylindrical zone 12 is continued towards the end of the neck of the bottle by a first cylindrical part 13 connected, by a part 15 in the form of a truncated cone, to a second cylindrical part 14 of smaller diameter and of smaller height than the first cylindrical part 13.

To the second cylindrical part 14 is connected a shoulder 16 from which is formed on the neck a conical thread 17. Beyond the threaded part, the neck has a truncated cone shaped part 18 of substantially the same slope as the part 15. The truncated cone shaped part 18 is followed by a cylindrical collar 19 ending in a flange 20. The flange 20 is limited by a substantially flat surface 21. The substantially flat surface 21 may, however, have slight irregularities due to the method of manufacture of the bottles, which normally includes a cut of the plastic tube from which the bottle originates by extrusion/-blowing. The substantially flat surface 21 is connected to an internal surface 22, which bulges slightly towards the inside of the cylindrical bottle, of collar 19 through a truncated cone shaped part 23 and a rounded part 24, the longitudinal section being thus somewhat in the form of an S.

Figure 1:
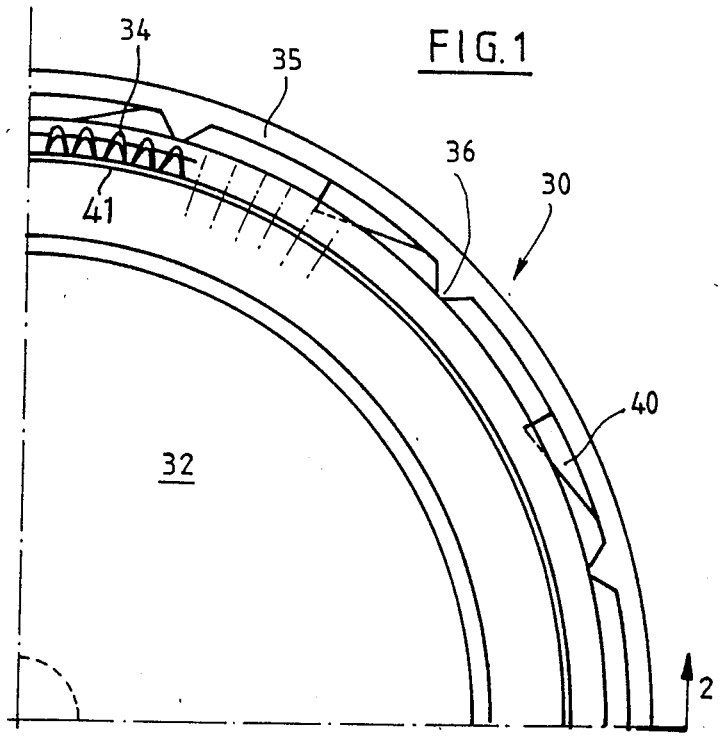
FIG. 1 is is a partial top view of a stoppering device in accordance with the invention, in a first embodiment.
Figure 2:
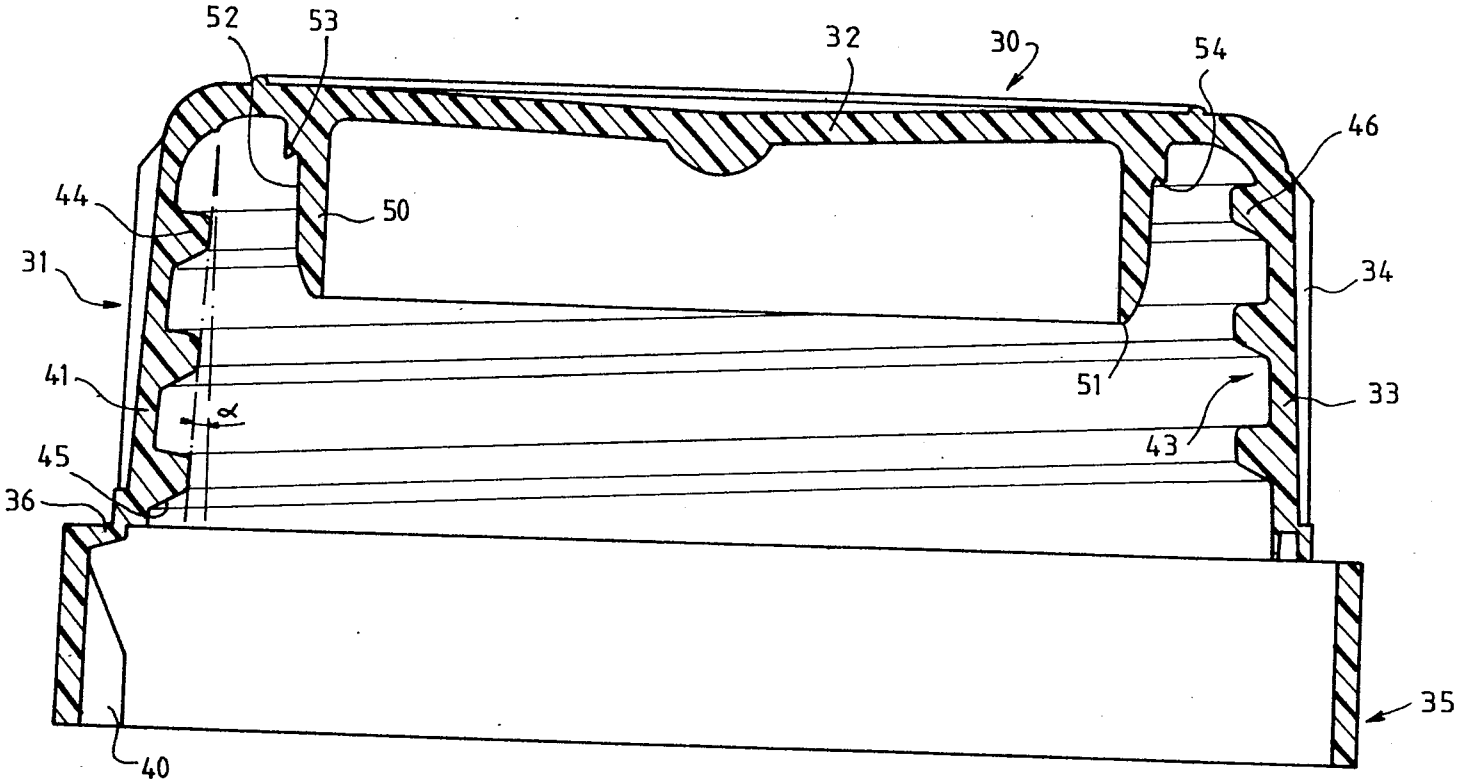
FIG. 2 is a sectional view along line 2—2 of FIG. 1.

A plastic material cap 30, FIGS. 1 and 2, is adapted to cooperate by screwing with the neck of the bottle B. The cap 30 is advantageously made from high density polyethylene—i.e., of a plastic having a hardness less than that of the material forming the bottle B.

The cap 30 is shaped as a cup 31 with a bottom 32 and a tapering side wall 33 which, on its external face, has ribs 34 intended to facilitate gripping of the cap 30 for opening and/or closing the bottle to which it is fitted. A pilfer or tamper proof strip 35, forming an integral part of the cap 30 prior to closure of the bottle and as long as the bottle has not been opened for a first time, is connected to the side wall 33 of the cap 30 by bridge means 36 evenly spaced apart from the angular point of view. The bridge means 36 are adapted to be broken when the bottle is opened for the first time.

On the internal face of the strip 35 are provided extra thick portions 40 at regular angular intervals. The extra thick portions 40 are somewhat similar to pawls or catches. They have a triangular cross section over a part of their height, and they are adapted to cooperate with antireturn notches 42 of a mating shape 42, FIG. 3*a*, formed at regular intervals on the first cylindrical part 13 of the bottle B.

The cap 30 comprises on the inner face 41 of its tapering side wall 33 a conical thread 44 whose starting point 45 is in the vicinity of the connecting zone of the cap proper (i.e., the cup 31) with the strip 35 and whose end 46 is situated in the vicinity of the bottom 32 of the cup 31.

The conical thread 44 has a taper of between 2° and 10°and, is advantageously of the artillery type, which provides good locking.

In one embodiment having given good results, the conical thread 44 has a screw of a turn and a half with a taper of 3°, as shown by angle $\alpha$ in FIG. 2.

The value chosen for the cap taper enables the cap to have a cylindrical outer surface while keeping a small wall thickness, so that both the quantity of plastic material used and the price are small.

According to the invention, the cap 30 further comprises a cylindrical skirt 50 directed towards the inside of the cup 31 from the bottom 32. The height of the cylindrical skirt 50 is on the order of half that of the cup 31, and the diameter of the cylindrical skirt 50 on its external surface 52 is slightly greater than that of the internal surface 22 of the bottle B. The cylindrical skirt 50 penetrates with the bottle B first of all by its thinned end 51.

According to another feature of the invention, an annular lip 53 is provided at the connection of the cylindrical skirt 50 with the bottom 32 of the cup 31. The annular lip 53 has a diameter slightly greater than that of the external surface 52 and is connected to the external surface 52 by a rounded portion 54.

For using a device of the invention, the cap 30 is fed to a screwing head, the bottle B being held motionless by cooperation between a star and the collar 10 so as to exert no vertical force on the bottle. Surface sealing is provided from the very beginning of the screwing operation, when the cylindrical skirt 50 is fitted into the cylindrical collar 19 with a slight resilient deformation of the latter. Cooperation of the annular lip 53 with the truncated cone shaped part 23 of the flange 20 forms a longitudinal positioning stop. At the end of screwing, the extra thick portions 40 of the pilfer or tamper proof strip 35 cooperate with the antireturn notches 42 on the neck of the bottle B, on which they are positioned during screwing by slight resilient deformation of the strip 35.

Sealing provided by the stoppering is excellent, although the two materials used are of comparable hardness. Moreover, the pilfer proofness is perfect, since the cap 30 cannot be unscrewed without breaking the bridge means 36 connecting the tamper proof strip 35 to the rest of the cap.

The conical thread of the device of the invention provides perfect fitting of the cap 30 on the neck despite the possible existence of imperfections of the shape of the neck of the bottle or an unsatisfactory positioning of the bottle with respect to the screwing head. Furthermore, the torque applied by the screwing head is used entirely for the screwing, without having to overcome friction forces, as was frequently the case in prior art cylindrical thread devices.

Closure is thus provided more readily and easily, at the end of screwing, and with a constant clamping force.

Reference will now be made to FIGS. 4 to 7, showing another embodiment. In this embodiment the body of the bottle B, also made from PVC and obtained by extrusionl blowing, has a rectangular cross section. However, the structure of the neck of the bottle B is identical to that of the above described embodiment. Accordingly, corresponding parts bear, in the following description, the same references as those used above, but the index "′" has been added to the part number in each case.

Thus, the bottle B comprises, above the collar 10′, a first cylindrical part 13′ on which are formed antireturn notches 42′ intended to cooperate with the catches 59 of a pilfer or tamper proof strip 67 of a cap 60. The cap 60 is, advantageously molded from high density polyethylene. It is shaped as a cup 61 with side walls 62 of a truncated cone shape and having an external ribbed surface, as shown at 63. Similarly to what was described above, the cap 60 is provided, on the internal face 64 of its side wall 62, with a conical thread 65 which starts in the vicinity of the connecting zone between the cap proper (i.e., the cap 61) and the pilfer proof strip 67, identical to that described above and connected to the body of the cap by breakable bridge means 66.

The conical thread 65 is similar to that of the above described embodiment i.e., it is made with a screw of a turn and a half, of the artillery type, and with a taper angle of about 2° to 10°, advantageously 3°.

In this embodiment, however, the sealing element, instead of being formed by a cylindrical skirt, is formed by a cup 71, with a bottom 72, and with a truncated cone shaped side wall 70.

The cup 71 has a taper opposite that of the side wall 62. That is to say, the apex of the cone defining the truncated cone shaped side wall 70 is situated inside the cap 60 and/or the bottle B when the cap 60 is in position, whereas the apex of the cone defining the side wall 62 of the cup 60 is outside the bottle B.

Figure 5:
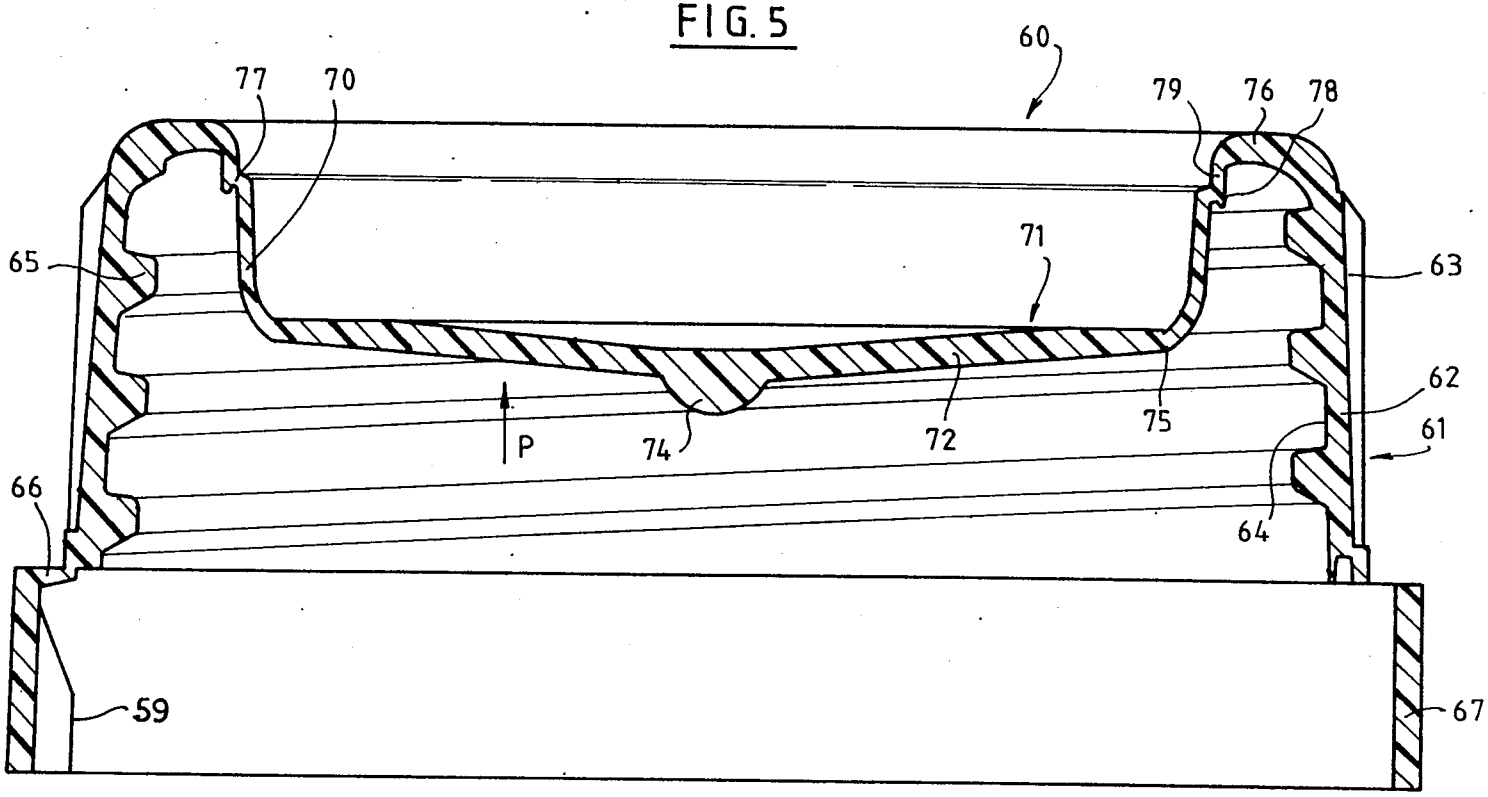
FIG. 5 is a sectional view through line 5—5 of FIG. 4.

As can be seen in FIG. 5, the bottom 72 of the cup 61—with a slight conical shape turned outwardly of the cap 60 and with a small extra thick portion 74 at its center—is connected to the truncated cone shaped side wall 70 by a rounded zone 75. In accordance with the invention, the truncated cone shaped side wall 70 is connected to an annular bottom zone 76 of the cap 60 by a zone or bend 77. The bend 77 is relatively flexible and is more easily deformable than the rest of the cup 71 in order to facilitate fitting of the truncated cone shaped side wall 70 of the cup 71, forming the sealing zone, into the internal surface 22′ of the cylindrical collar 19′ of the bottle B.

The cap 60 also has, in the neighbourhood of the bend 77, a cylindrical lip 78 of small height having a diameter slightly bigger than that of the truncated cone shaped side wall 70. The cylindrical lip 78 forms the end of a short cylindrical sleeve 79 connected to the annular bottom zone 76 and outside the cup 71, to which the annular bottom zone 76 is connected by the bend 77.

The use of this embodiment is similar to that of the preceding embodiment.

During screwing of the cap on the bottle B, the cup 71, whose depth is approximately half the height of the cap properly speaking, penetrates into the neck of the bottle B and provides a surface sealing by contact of the external surface of the truncated cone shaped side wall 70 with the internal surface 22′ of the collar 19′. Abutment of the cylindrical lip 78 against the truncated cone shaped part 23′ of the flange 20′ of the bottle provides longitudinal positioning.

Figure 3:
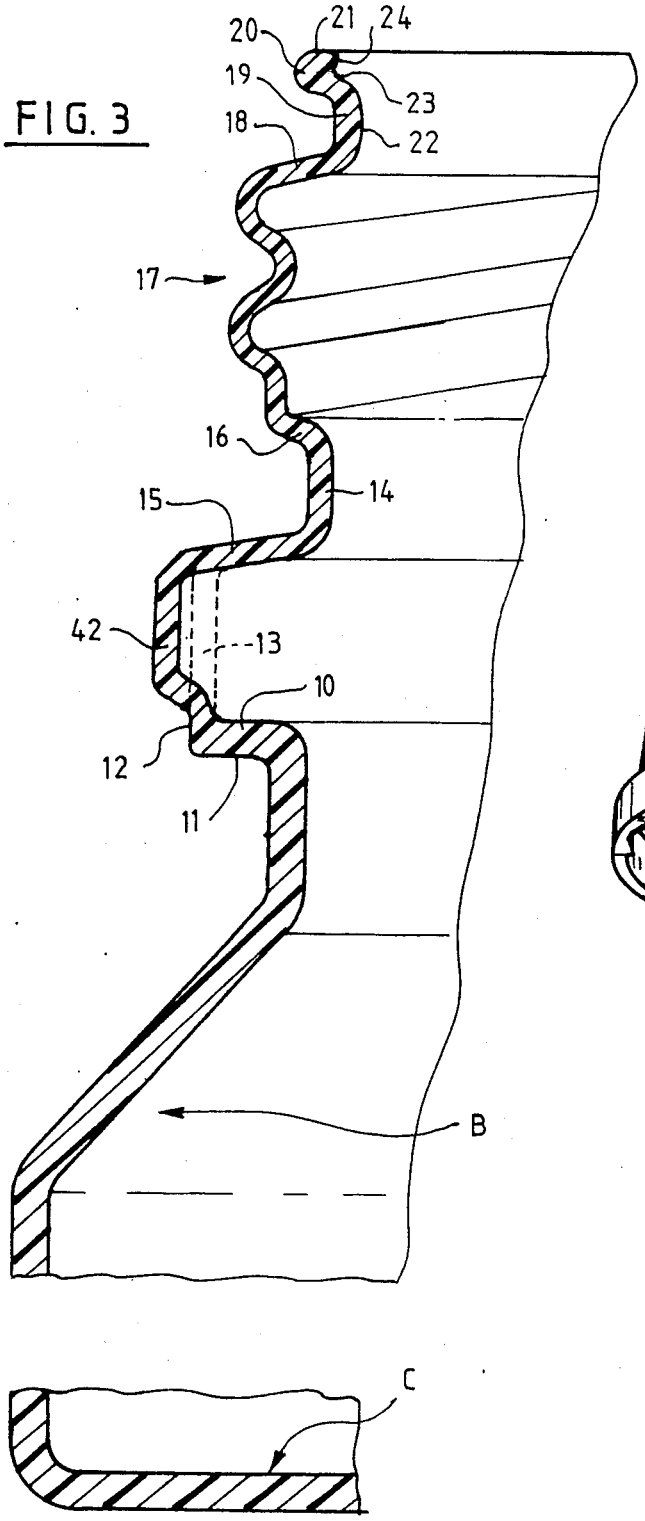
FIG. 3 is a partial longitudinal sectional view of a bottle in accordance with the invention.
Figure 7:
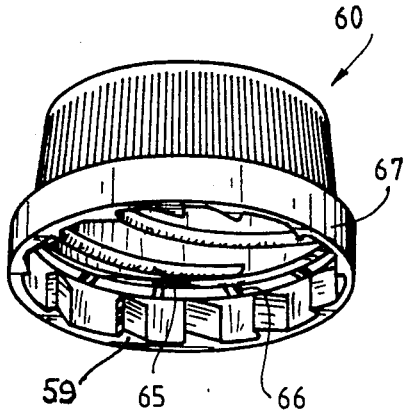
FIG. 7 is a perspective view of the cap shown in FIGS. 4 and 5.

In this embodiment, and as indicated above for the embodiment shown in FIGS. 1 to 3, the use of a conical thread overcomes a possible lack of concentricity of the parts constituting the device and allows good penetration of the cup 71 into the bottle B, without any wedging effect likely to cause jamming or tears or likely to damage the bottle.

This good result is obtained—particularly in so far as the sealing of bottles with a rectangular cross section is concerned (i.e., whose body is connected to the neck by flat portions and which were therefore considered as more difficult to stopper)—, because of the resiliently deformable bend 77 and the cylindrical lip 78.

Furthermore, the fact of using the torque of the screwing machine only for screwing and at the end of the screwing path allows the cap 60 to shape the neck of the bottle with constant clamping force. Closure is thus provided reliably and rapidly whatever the running conditions, particularly during the warmer summer season, which is an important factor for machines with high output rate, of the type used at the present time in bottling factories.

An embodiment such as is described above is particularly well adapted to the closure of bottles which are to be stacked. In this case, in fact, the internal pressure of the bottle increases, particularly that at the bottom of the pile. The relatively thicker bottom 72 of the cup 61 is then deformed by a thrust in the direction P (see FIG. 6), which tends to make the bottom horizontal, with consequently a more intense lateral reaction, in line with the sealing zone (i.e., in contact with the external face of the truncated cone shaped side wall 70 and of the internal surface 22′ of the bottle B).

Figure 6:
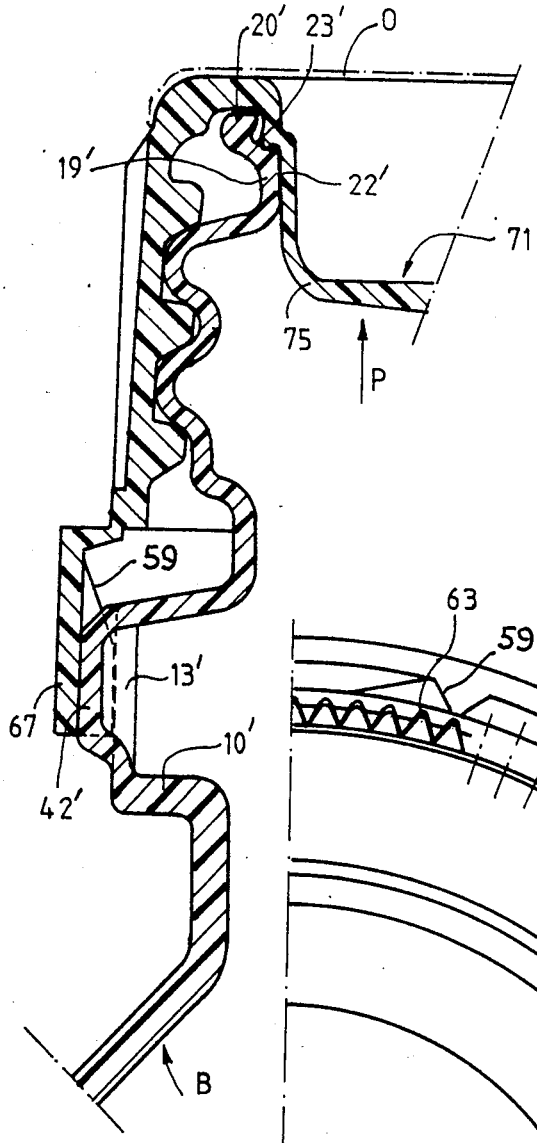
FIG. 6 is a partial view in longitudinal section of a bottle equipped with a device comprising a cap according to FIGS. 4 and 5.
Figure 4:
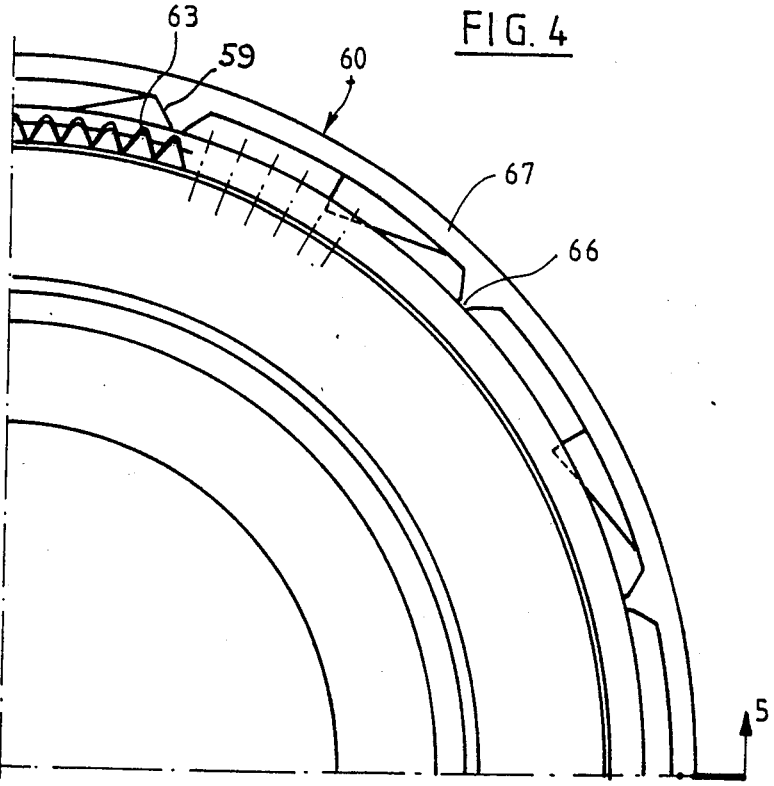
FIG. 4 is a view similar to FIG. 1 but for another embodiment.

In a modification, shown schematically in FIG. 6, a metal sealing foil, most simply made from an aluminium film, is added to the cap 60 and is thermowelded or thermobonded to the annular bottom zone 76 of the cap and to part of the periphery thereof.

The sealing foil, shown at 0, may advantageously carry advertizing matter.

Furthermore, the sealing foil 0 contributes to the good conservation of the contents of the bottle by forming a gas impervious barrier and also, if such be the case, avoids the introduction into cup 71 of humidity and/or undesirable products such as fragments of packings or similar.

Although the invention has been described with reference to embodiments of the cap comprising a pilfer or tamper proof strip, it finds applications for embodiments similar to those described above, but without the strip. More particularly, the invention finds application in all cases where it is desired to obtain stoppering with good sealing for plastic material bottles, in particular bottles obtained by extrusion/blowing of PVC.

What is claimed is:

1. A bottle cap molded from a plastic material piece shaped with a bottom and a side wall symmetrical about a longitudinal axis and joined to said bottom, a conical thread on the internal face of said side wall for holding said bottle cap on the neck of a bottle during screwing of said conical thread on the bottle, a skirt spaced apart from said side wall and coaxial with said side wall and of a smaller length than said side wall as measured parallel to said axis, said skirt extending from said bottom inwardly of said side wall and being adapted for cooperating by surface contact with the inside of the neck of the bottle during said screwing, and a lip immediately adjacent the external surface of said skirt and adjacent to but spaced from said bottom, said lip being adapted to make abutting contact during use with a truncated cone shaped part in the neck of a bottle into which said bottle cap is inserted, said lip having an external diameter slightly greater than the external diameter of said skirt but slightly less than the internal diameter of the neck of the bottle in which it penetrates at the end of said screwing so as to form a stop in the longitudinal direction of said axis.

2. The bottle cap as claimed in claim 1, wherein the angle of said conical thread is between 2° and 10°.

3. The bottle cap as claimed in claim 2, wherein said angle is of the order of 3°.

4. The bottle cap as claimed in claim 1, wherein said skirt has a first end and a second end, the end of said skirt nearest to said bottom is connected thereto by a zone with greater elastic deformability than the rest of said bottle cap, and the other end of said skirt is closed by a wall, said wall having an extra thick portion in the vicinity of its central part and being shaped with a conical surface having its conicity in the opposite direction to that of said conical thread.

5. The bottle cap as claimed in claim 1 further including, at the end of said side wall the furthest away from said bottom, a thief proof ring, bridges connecting said thief proof ring and said side wall together, teeth on the internal face of said ring adapted to cooperate during use with teeth on the external surface of the neck of the bottle, said teeth on the ring and the teeth on the bottle being engaged when said bottle cap is immobilized longitudinally on the bottle at the end of screwing said bottle cap on the bottle.

6. The bottle cap as claimed in claim 5, wherein said bottle cap is made from high density polyethylene.

7. The bottle cap as claimed in claim 5, wherein said bottom is annular in shape and further includes on the outside of said bottle cap a cover made from a metal film thermofixed on the periphery of said annular bottom.

8. A cap for a bottle, said cap:

(a) being molded from a plastic material;

(b) having a bottom end and an at least substantially cylindrical side wall, each of which has an external surface and an internal surface, the internal surface of said at least substantially cylindrical side wall being tapered conically outwardly away from said bottom;

(c) having a conical thread on the internal surface of said at least substantially cylindrical side wall;

(d) having an at least generally cylindrical skirt extending at least generally perpendicularly from the internal surface of said bottom coaxially of said at least generally cylindrical side wall, said at least generally cylindrical skirt having an external surface, an internal surface, and a shorter length than said at least generally cylindrical side wall and being sized, shaped, and positioned to make surface contact with and to slide axially relative to the inside of the neck of the bottle while said cap is being screwed on or off the bottle; and (e) having an annular lip on the external surface of said at least generally cylindrical skirt adjacent to but spaced from the internal surface of said bottom, said annular lip being sized, shaped, and positioned to make axial abutting contact with a corresponding lip in the neck of the bottle when said cap is screwed onto the neck of the bottle to the maximum extent.

9. A cap as recited in claim 8 wherein the cone angle of said conical thread is between 2° and 10°.

10. A cap as recited in claim 9 wherein the cone angle of said conical thread is on the order of 3°.

11. A cap as recited in claim 8 wherein said at least generally cylindrical skirt has an annular zone of greater elastic deformability adjacent said annular lip on the side thereof away from said bottom.

12. A cap as recited in claim 11 and further comprising an at least generally planar surface connecting the end of said at least generally cylindrical skirt remote from said bottom.

13. A cap as recited in claim 12 wherein said at least generally planar surface is slightly bowed away from said bottom.

14. A cap as recited in claim 11 wherein the external surface of said at least generally cylindrical skirt is slightly conical and has a cone angle opening toward said bottom.

15. A cap for a bottle, said cap:

(a) being molded from a plastic material;

(b) having an annular first bottom and an at least substantially cylindrical side wall, each of which has an internal surface and an external surface, the internal surface of said at least substantially cylindrical side wall being tapered conically outwardly from said annular first bottom;

(c) having a conical thread on the internal surface of said at least substantially cylindrical side wall;

(d) having an at least generally cylindrical skirt extending at least generally perpendicularly from the inner edge of the internal surface of said annular first bottom coaxially of said at least generally cylindrical side wall, said at least generally cylindrical skirt having an external surface, an internal surface, and a shorter length than said at least generally cylindrical side wall and being sized, shaped, and positioned to make surface contact with and to slide axially relative to the inside of the neck of the bottle when said cap is being screwed on or off the bottle;

(e) having an annular lip on the external surface of said at least generally cylindrical skirt adjacent to but spaced from the internal surface of said annular first bottom, said annular lip being sized, shaped, and positioned to make axial abutting contact with a corresponding annular lip in the neck of the bottle when said cap is screwed on to the neck of the bottle to the maximum extent; and (f) having a second bottom connecting the end of said at least generally cylindrical skirt remote from said annular first bottom.

16. A cap as recited in claim 15 wherein the cone angle of said conical thread is between 2° and 10°.

17. A cap as recited in claim 16 wherein the cone angle of said conical thread is on the order of 3°.

18. A cap as recited in claim 15 wherein said at least generally cylindrical skirt has an annular zone of greater elastic deformability adjacent said annular lip.

19. A cap as recited in claim 15 wherein the external surface of said at least generally cylindrical skirt is slightly conical and has a cone angle opening towards said bottom.

20. A cap as recited in claim 15 wherein said second bottom is slightly bowed away from said annular first bottom.

* * * * *